United States Patent [19]

Lindkvist

[11] 4,311,275

[45] Jan. 19, 1982

[54] DEVICE FOR USE IN APPARATUS FOR THERMAL SPRAYING

[76] Inventor: Erik A. Lindkvist, Korpralsvägen 38, S-902 53 Umeå, Sweden

[21] Appl. No.: 103,083

[22] Filed: Dec. 12, 1979

[30] Foreign Application Priority Data

Dec. 18, 1978 [SE] Sweden ..... 7813009

[51] Int. Cl.[3] ..... B05B 17/06

[52] U.S. Cl. ..... 239/102

[58] Field of Search ..... 239/102, 282, 407, 297, 239/543, 291, 292, 299; 116/137 A; 261/DIG. 48; 310/322, 326; 179/110 A

[56] References Cited

U.S. PATENT DOCUMENTS 2,855,244 10/1958 Camp ..... 239/102
3,114,654 12/1963 Nishiyama ..... 239/102
3,147,146 9/1964 Sedlacsik, Jr. ..... 239/102
3,374,953 3/1968 Bodine ..... 239/102
3,986,669 10/1976 Martner ..... 239/102

*Primary Examiner*—James B. Marbert

[57] ABSTRACT

The invention relates to a device for use in an apparatus for thermal spraying, i.e. for the application of metal, metal alloys, ceramets, carbides, ceramic metals, plastic materials or the like by means of heat and a pressure medium, in order to form a coating layer on the workpiece, comprising a per se known spraying apparatus provided with a nozzle, and a means (3) including a through opening or passage (2) defined by a wall and placed after the spray nozzle to compress or densify the otherwise conically flaring spray jet consisting of finely divided droplets or particles. The novelty resides in the feature that the wall (3) defining said passage (2) is subjected to the action of an oscillation or vibration generator setting the wall in controlled oscillatory or vibratory motion.

9 Claims, 8 Drawing Figures

DEVICE FOR USE IN APPARATUS FOR THERMAL SPRAYING

The present invention relates to a device for use in an apparatus for thermal spraying, i.e. for the application of metal, metal alloys, cermets, carbides, ceramic metals, plastic materials or the like by means of heat and a pressure medium, in order to form a coating layer on a workpiece, comprising a per se known spraying apparatus provided with a nozzle, and a means including a through opening or passage and placed after the spray nozzle to compress or densify the otherwise conically flaring spray jet consisting of finely divided droplets or particles.

In apparatuses for thermal spraying it is already known to arrange funnel- or tube-shaped means after the nozzle, as counted in the spraying direction, in order to concentrate and densify the spray jet.

A serious disadvantage associated with prior art apparatuses is that they are liable to be clogged by adhering spray material gradually forming a deposit which is torn loose and thrown towards the workpiece, thus impairing the spray result. Even a comparatively thin deposit will substantially restrain the throughflow and consequently reduce the amount of material applied.

Various solutions have been proposed for the above-mentioned problems but none of them has proved to result in an acceptable function.

The object of the invention is to provide a device which solves the problem of building up a deposit and which thus improves the function.

The essential characteristic of the device of this invention is that a wall defining said passage is subjected to the action of an oscillation or vibration generator setting the wall in controlled oscillatory or vibratory motion.

Embodiments of the device according to the invention will be described more fully hereinafter with reference to the accompanying drawings, in which:

FIG. 1 illustrates generally how the device according to the invention is positioned.

Figure 1:
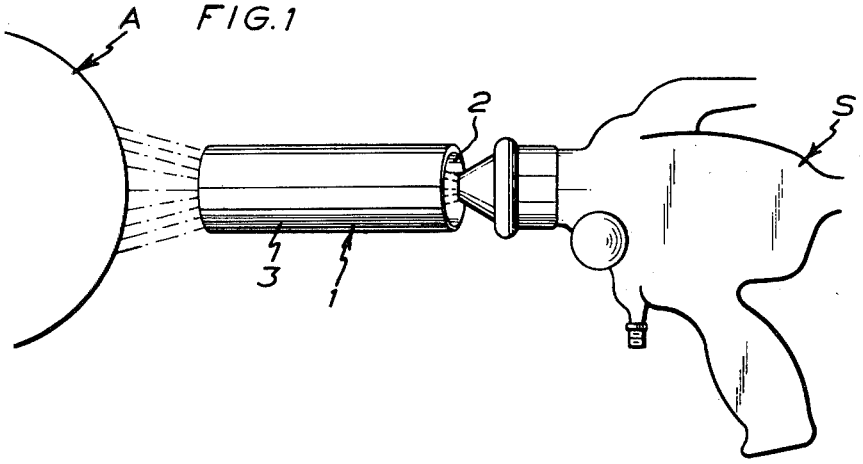
FIG. 1 illustrates how the device is mounted on the spraying apparatus.

The apparatus for thermal spraying, which may be of a per se known type, is designated by S. The workpiece to be coated is designated by A. The device of the invention, designated 1 in FIG. 1, includes a through opening or passage 2 through which the jet of molten material from the apparatus S is compelled to pass. Under the influence of the wall of a tube 3, which defines the passage 2, the jet is densified, so that spreading of the jet outside the workpiece is eliminated and the application of coating can be more concentrated.

Figure 2:
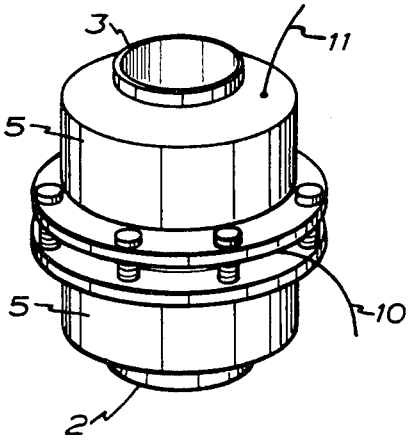
FIGS. 2 and 3 are respectively a diagonal side view and a longitudinal sectional view of an embodiment of an ultrasonically operating device.
Figure 3:
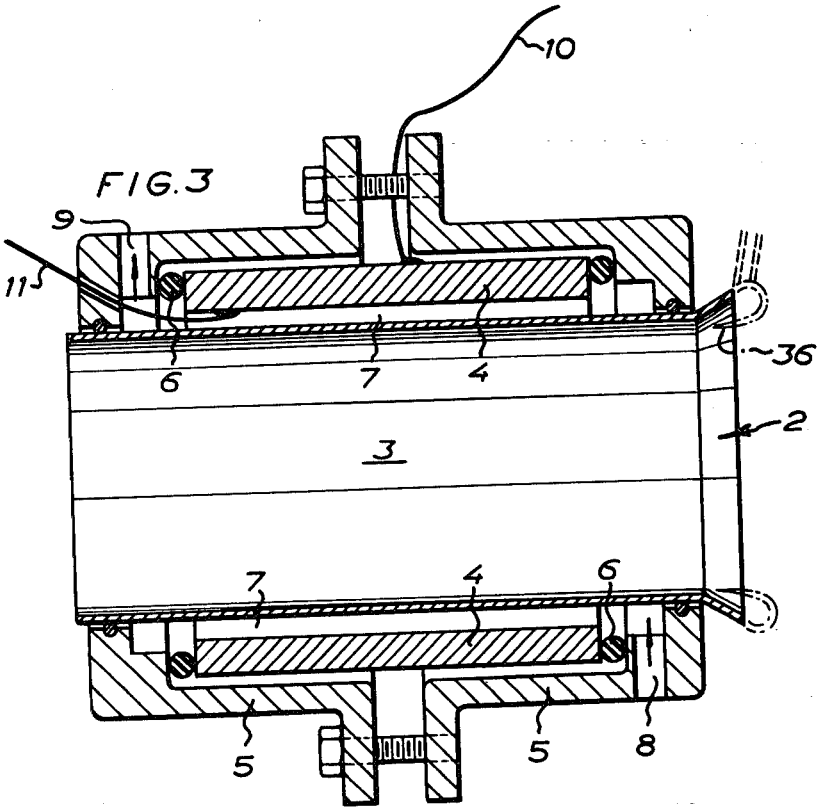

In the embodiment of FIGS. 2 and 3, the passage-defining tube 3 is surrounded by a tubular piezoceramic crystal 4. The crystal is enclosed in a casing 5 composed of two parts. The casing is sealed against the tube 3 and the crystal by means of sealing rings 6, FIG. 3, so that a slot-shaped space 7 is formed between the tube and the crystal. A coolant, which both cools the crystal and controls the temperature of the tube wall, is allowed to pass through said space. The coolant is introduced through the connection 8 and is discharged via the connection 9. With this type of crystals electrical current lines 10 and 11 are connected respectively to the inside and outside of the crystal.

Figure 4:
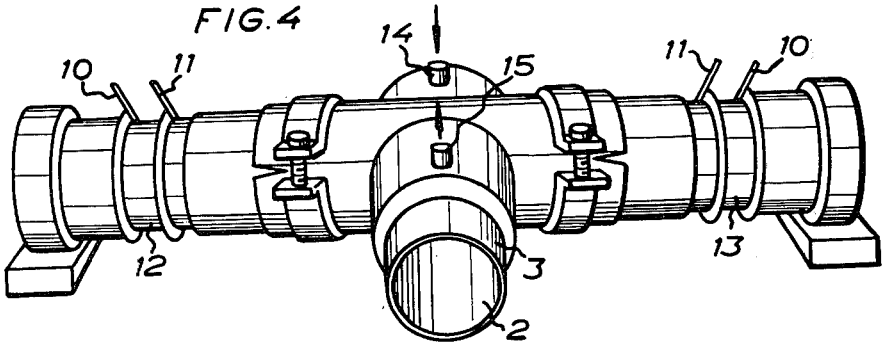
FIG. 4 is a diagonal front view of another embodiment of an ultrasonically operating device.

In the embodiment of FIG. 4 use is made of two crystals 12 and 13 placed on either side of the passage-defining tube 3. Also in this case a space for coolant, entering and leaving through respectively the connections 14 and 15, is arranged around the tube 3.

When current of the intended frequency is supplied to the crystal 4 and to the crystals 12 and 13, the tube 3 is set in vibration, whereby the tendency of the spray material, passing through the tube, to adhere to the tube wall is strongly reduced.

Figure 5:
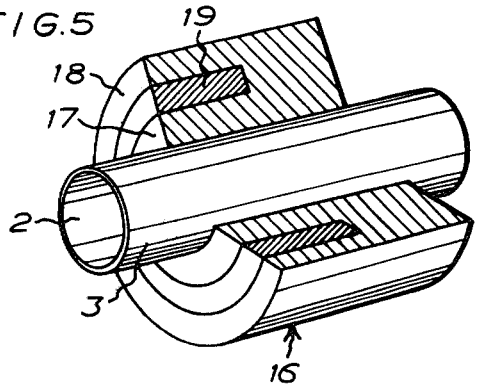
FIG. 5 is a diagonal, partly cut front view of a first embodiment of an electromagnetically operating device.

The embodiment of FIG. 5 is of electromagnetic type. Arranged around the tube 3, which defines the passage 2, is a ring-shaped electromagnet 16. The electromagnet is composed of two cores 17 and 18 and an intermediate winding 19. When alternating current is supplied to the electromagnet the tube 3 is set in oscillatory motion. Electromagnet type embodiments are primarily suitable for non-magnetic spray materials.

Figure 6:
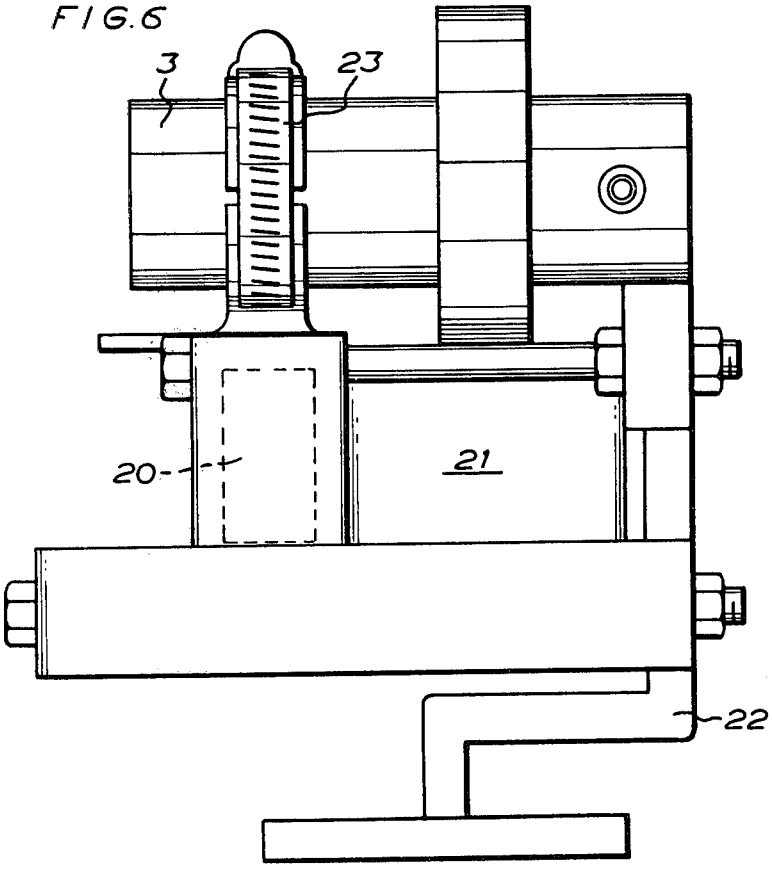
FIG. 6 is a side view of a second embodiment of an electromagnetically operating device.

FIG. 6 shows how a passage-forming tube 3 is rigidly connected to an armature 20 which is actuated via an air gap by a substantially horseshoe-shaped electromagnet 21 mounted on an frame 22. The tube 3 is secured to the armature by means of a bracket 23. The electromagnet produces a sinusoidal oscillatory motion in the tube.

Figure 7:
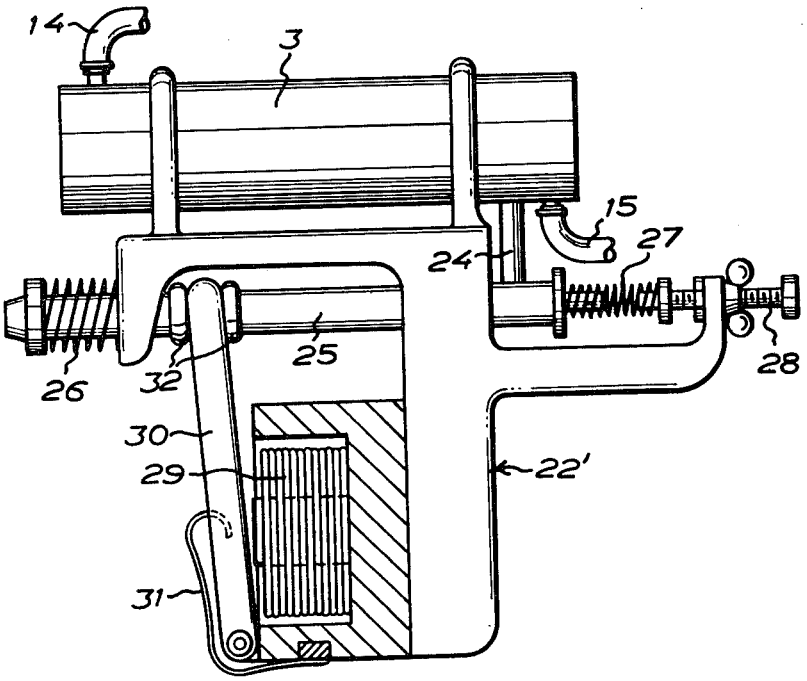
FIG. 7 is a partly sectional side view of still another embodiment of an electromagnetically operating device.

In the embodiment of FIG. 7 the passage-defining tube 3 is movable relative to a frame 22' and via an arm 24 it is rigidly secured to a rod 25. The tube 3 is suitably provided with a coolant compartment with an inlet 14 and an outlet 15. The rod 25 and, consequently, the tube 3 are suspended in the frame 22' by means of springs 26 and 27. At least one spring 27 is provided with an adjusting or regulating device 28. An electromagnet 29 is fixedly arranged in the frame 22'. An armature 30 for the electromagnet is pivotally mounted on the frame and provided with a return spring 31. At one end the armature 30 is fork-shaped and engages the rod 25 between two flanges 32 provided on the rod.

When current applied to the armature at a number of periods adapted to the purpose the armature will reciprocate and displace the rod 25 in the axial direction thereof. The rod, in turn, imparts a vibratory motion to the tube via the arm 24.

Figure 8:
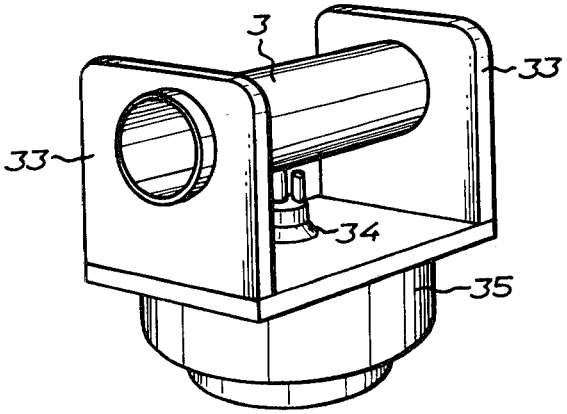
FIG. 8 is a diagonal perspective front view of an electromechanically operating device.

In the electromechanical type embodiment illustrated in FIG. 8 a passage-defining tube 3 is movably mounted in a frame 33 and connected with a motor 35 via a vibrator 34.

As the tube 3 is set in oscillation or vibration in the various manners shown by way of example, the static friction between the spray material and the tube wall is transformed into dynamic friction, which means that the friction is considerably reduced. The dynamic friction will amount to about $1/\sqrt{2}$ is the static friction is assumed to be 1.

Obviously the function may be further improved by combining the oscillation or vibration with other means, providing e.g. a friction-reducing medium layer along the tube wall. As such a medium one may advantageously utilize a protective gas which, as indicated by broken lines in FIG. 3, is introduced through an annular slot 36 at the inlet end of the passage 2 and the spreading of which can be carefully checked. As the protective gas sealingly surrounds the spray jet and follows this jet up to the workpiece there is obtained a satisfactory protective function at the same time as the required amount of protective gas can be kept at an acceptable level.

The protective gas flowing out through the annular slot 36 at the end of the passage-defining tube 3 adjacent a nozzle constitutes a friction-reducing boundary layer between the spray jet and the tube wall.

Vibration or oscillation alone will reduce the tendency of spray material to adhere to the tube wall. An improved effect is gained if the vibration is adjusted or controlled so as to obtain a directed wave-formation acting in the spraying direction. This can be achieved by controlling the oscillation generator.

In addition to the advantage already mentioned, i.e. that the spreading is reduced and, consequently, that the wastage of spray material is reduced, the device of the invention has a considerable positive influence on the working environment. The concentrated spray jet and the reduction of wastage result in a substantial reduction of the quantity of particles in the air around the working area.

From a production-economical point of view the device has the advantage that the time required for the application of coating may be reduced and this is due to the fact that it is possible with a concentrated jet to apply a thicker layer with smaller overlap zones than those required when the jet is allowed to spread.

The tubular means surrounding the jet and connected to the nozzle also implies that noise from the spray nozzle is reduced by up to 6–8 dbA.

It is obvious that the device may be varied within wide limits. Thus, the invention should not be considered restricted to that described above and illustrated in the drawings, but it may be modified in various ways within the scope of the appendant claims.

What I claim and desire to secure by Letters Patent is:

1. A device for use in an apparatus for thermal spraying, i.e. for the application of metal, metal alloys, ceramets, carbides, ceramic metals, plastic materials or the like by means of heat and a pressure medium, in order to form a coating layer on a workpiece, comprising a per se known spraying apparatus provided with a nozzle, and a means (3), including a through opening or passage (2), and placed after the spray nozzle to compress or densify the otherwise conically flaring spray jet consisting of finely divided droplets or particles, wherein a wall (3) defining said passage (2) is subjected to the action of an oscillation or vibration generator setting the wall in controlled oscillatory or vibratory motion.

2. A device as claimed in claim 1, wherein the means producing oscillation includes an ultrasound generator (4, 12, 13).

3. A device as claimed in claim 1, wherein the means producing oscillation includes an electromagnetic oscillation generator (17–19).

4. A device as claimed in claim 1, wherein the means producing oscillation includes an electromechanical oscillation generator (21, 22; 29, 30).

5. A device as claimed in claim 2, wherein the ultrasound generator includes a piezoceramic cylindrical crystal (4) through which a tube defining the passage extends.

6. A device as claimed in claim 1, wherein the oscillation or vibration generator is adapted to impart to the wall defining the passage a directed wave motion acting in the spray direction.

7. A device as claimed in any one of the preceding claims, comprising means for regulating the temperature of the wall defining the passage.

8. A device as claimed in claim 1, comprising means (36) for producing a flow in the spraying direction of a medium, preferably protective gas, along the wall (3) defining the passage (2).

9. A device for use in an apparatus for thermal spraying, i.e. for the application of metal, metal alloys, ceramets, carbides, ceramic metals, plastic materials or the like by means of heat and a pressure medium, in order to form a coating layer on the workpiece, comprising a per se known spraying apparatus provided with a nozzle, and a means (3) including a through opening or passage (2) and placed after the spray nozzle to compress or densify the otherwise conically flaring spray jet consisting of finely divided droplets or particles, wherein a wall (3) defining said passage (2) is subjected to the action of an oscillation or vibration generator setting the wall in controlled oscillatory or vibratory motion, and said device comprises means (36) for producing a flow in the spraying direction of a medium, preferably protective gas, along the wall (3) defining the passage (2).

* * * * *